US006386563B1

(12) United States Patent
Chen et al.

(10) Patent No.: US 6,386,563 B1
(45) Date of Patent: May 14, 2002

(54) LOCKING MECHANISM FOR SWIVEL SEAT OF BABY WALKER

(75) Inventors: Er-Jui Chen, Kaohsiung; Hung-Chung Hou, Chia-I Hsien, both of (TW)

(73) Assignee: Link Treasure Limited, Tortola (VG)

( * ) Notice: Subject to any disclaimer, the term of this patent is extended or adjusted under 35 U.S.C. 154(b) by 0 days.

(21) Appl. No.: 09/754,375

(22) Filed: Jan. 5, 2001

(51) Int. Cl.[7] ..... B62B 7/00
(52) U.S. Cl. ..... 280/87.051
(58) Field of Search ..... 280/87.05, 87.051, 280/87.03, 200, 202, 290, 647, 650, 657, 658; 297/5; 482/66, 68; 440/22

(56) References Cited

U.S. PATENT DOCUMENTS 592,569 A * 10/1897 Lehmann ..... 472/15
5,356,196 A * 10/1994 Chuang ..... 297/5
5,480,210 A * 1/1996 Lehenbauer et al. ..... 297/137
5,688,211 A * 11/1997 Myers ..... 482/66
6,012,731 A * 1/2000 Liu ..... 280/87.051
6,048,290 A * 4/2000 Chen et al. ..... 482/68
6,179,376 B1 * 1/2001 Meeker et al. ..... 297/1

* cited by examiner

*Primary Examiner*—Brian L. Johnson
*Assistant Examiner*—Bridget Avery
(74) *Attorney, Agent, or Firm*—Birch, Stewart, Kolasch & Birch, LLP

(57) ABSTRACT

A locking mechanism for a swivel seat of a baby walker is provided. The locking mechanism has a lock member which may be configured in a retained, free, or locked state with respect to the seat. When an infant rotates the seat to one of predetermined positions, the baby walker is locked so as to facilitate the feeding or playing of the infant.

1 Claim, 8 Drawing Sheets

LOCKING MECHANISM FOR SWIVEL SEAT OF BABY WALKER

BACKGROUND OF THE INVENTION

1. Field of Invention

The present invention relates to baby walkers and more particularly to a mechanism for locking swivel seat of baby walker in one of predetermined positions for facilitating the feeding by parent or the playing of infant.

2. Related Art

It is well known that baby walker is an exerciser for training an infant to walk. It is also understood that infant seated on baby walker may arbitrarily move to front, rear, left, or right. That is, the movement of baby walker is random and unpredictable. This may increase danger of the seated infant. A conventional baby walker comprises a seat for supporting the weight of infant, a circular frame (integrally formed with a tray), a stationary base, a plurality of legs intercoupled the base and the frame and support the seat, and a plurality of (e.g., four or six) wheels rotatably mounted under the base. Conventionally, wheels are caster wheels. Further, there is no locking mechanism provided in the baby walker. This is not safe in view of above. Hence, it is often recommended by manufacturers that parent or guardian should take great attention to the infant seated on baby walker. In fact, it is not unusual that accident may happen despite the attention being taken.

Of course, there is some baby walkers aimed at eliminating above drawback. And an improved baby walker to enable an infant seated on the walker to turn freely is disclosed in U.S. patent application Ser. No. 09/583,995 entitled "Baby Walker" wherein an annular flange is provided on tray with a rotatable disk member mounted thereon. The rotatable disk member comprises an outer wall, a top surface, and an inner wall. An annular groove is formed on the rotatable disk member. The bottom of outer wall is in contact with the top of the tray. A plurality of flexible tabs is provided on the bottom of the inner wall of the rotatable disk member for snapping into a plurality of corresponding slots on the inner wall of the tray and secured thereto. A plurality of holes are provided on the top surface of the rotatable disk member for receiving a plurality of corresponding pegs of seat. This forms a swivel seat. This can prevent an infant from feeling monotonous after several times of using the baby walker. However, infant may easily rotate the seat to turn its back on a parent of guardian who prepares to feed the infant. This really bothers the parent or guardian.

SUMMARY OF THE INVENTION

It is therefore an object of the present invention to provide a mechanism for locking a swivel seat of baby walker in one of predetermined positions for facilitating the feeding by parent/guardian or the playing of infant.

The advantages of the present invention are realized by providing a baby walker comprising a stationary tray, a swivel mechanism, a seat, a circular base, a plurality of legs, a lock member, and a plurality of wheels rotatably mounted under the base. Tray is capable of supporting seat, seated infant, and the swivel mechanism. Legs are intercoupled the base and the tray for supporting the tray at a predetermined height above the ground. Swivel mechanism is rotatbly mounted on tray and comprises a plurality of dents wherein the lock member is capable of engaging with one of the dents for fastening the seat to the swivel mechanism.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 1:
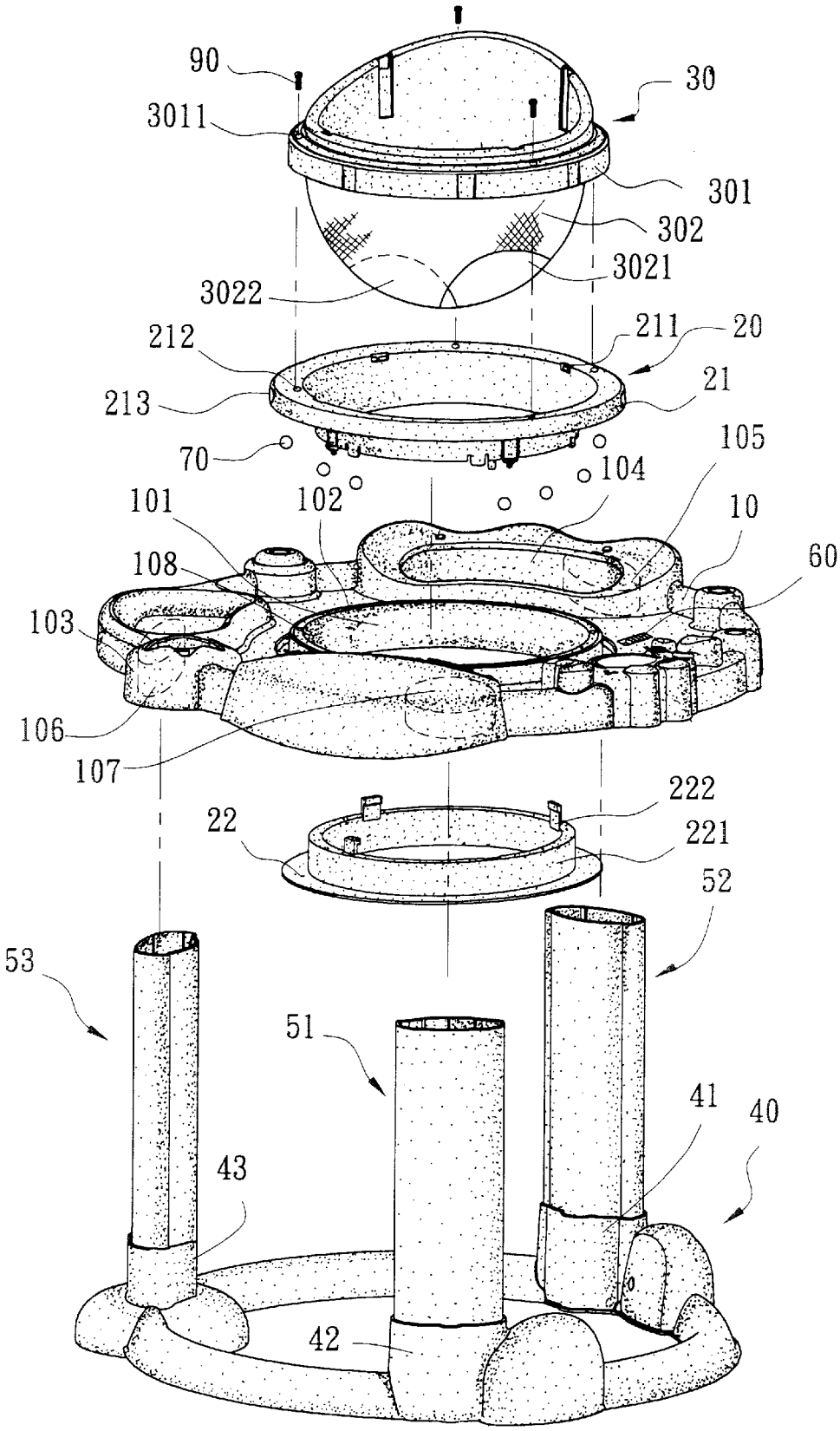
FIG. 1 is an exploded view of a first preferred embodiment of a baby walker incorporating a mechanism locking swivel seat according to the invention.
Figure 2:
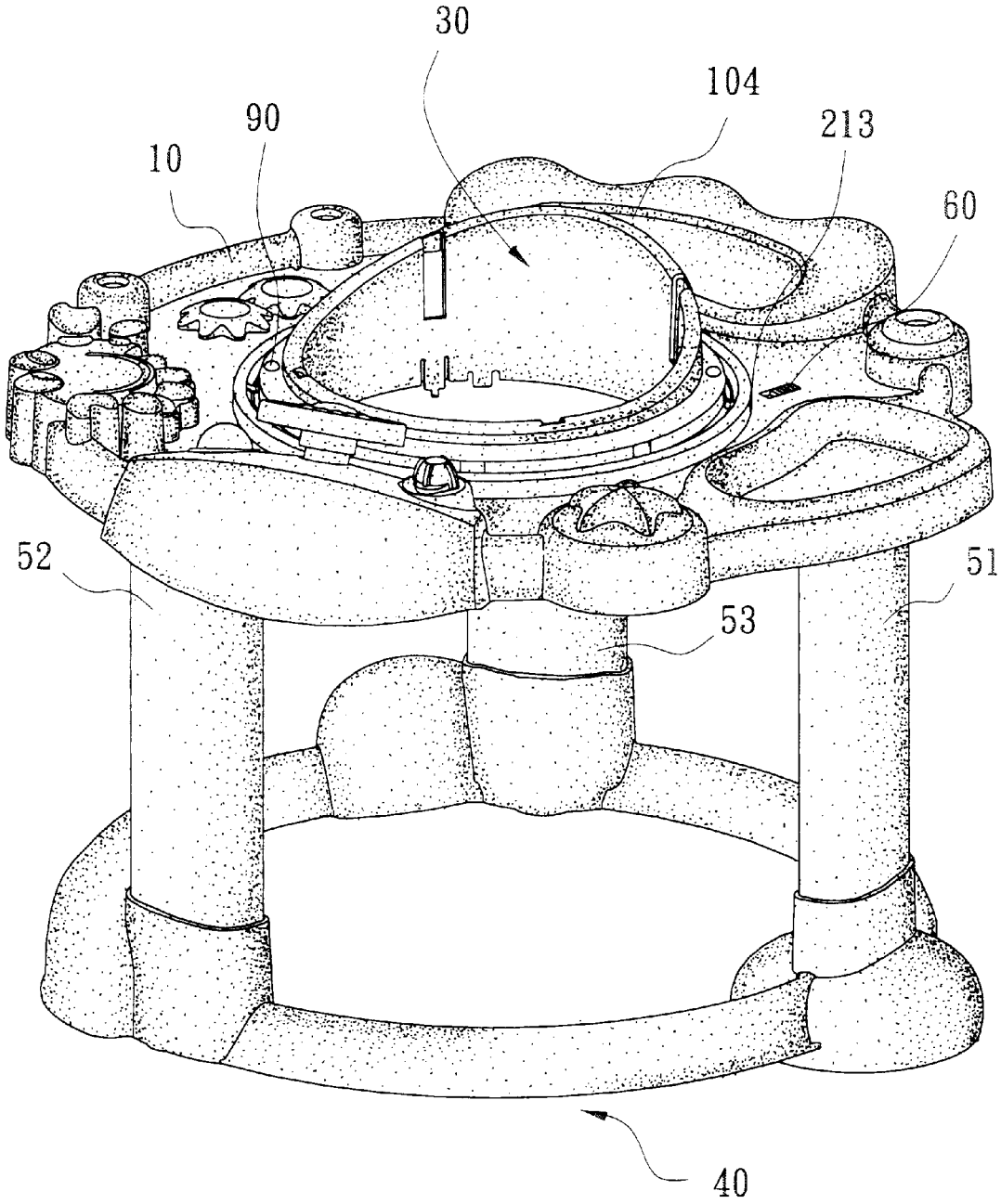
FIG. 2 is a perspective view of the FIG. 1 baby walker.
Figure 3:
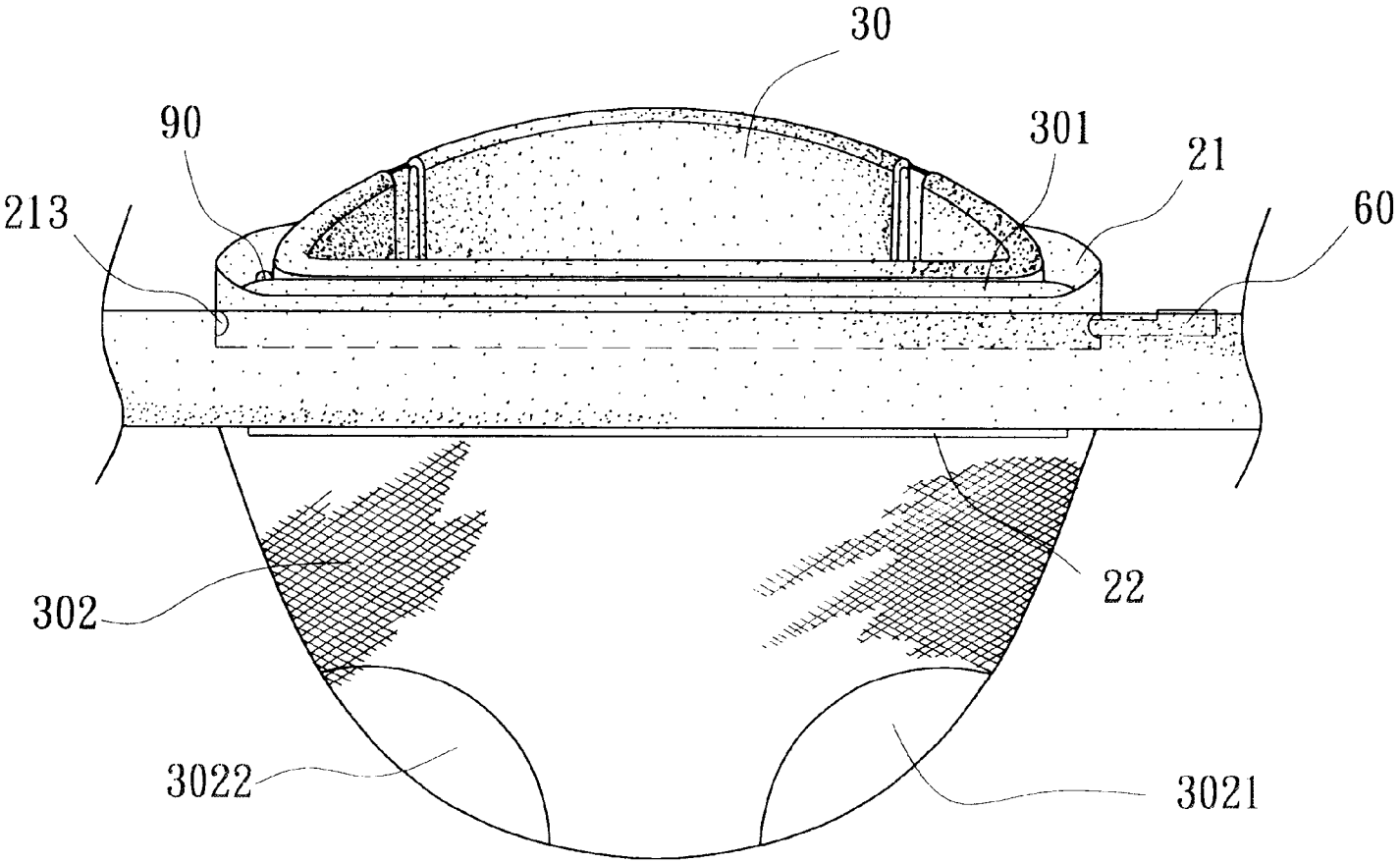
FIG. 3 is a side view schematically showing the seat, the lock member, and associated components shown in FIG. 1.
Figure 4:
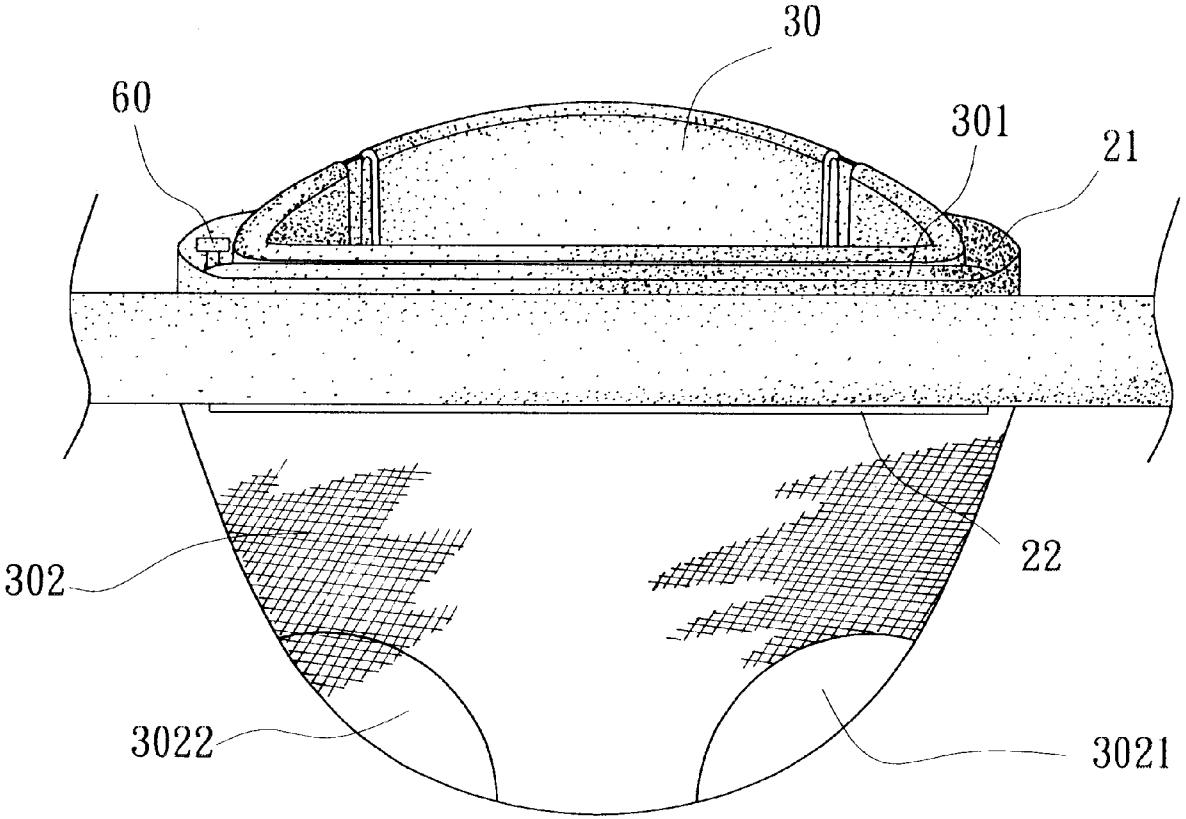
FIG. 4 is a view similar to FIG. 3 schematically showing the seat, the lock member, and associated components according to a second preferred embodiment of the invention.

Referring to FIGS. 1 to 3, there is shown a baby walker constructed in accordance with the invention comprising a stationary tray 10, a swivel mechanism 20, a seat 30, a circular base 40, a plurality of legs 51, 52, and 53, and a lock member 60. Each of above components will now be described below. Tray 10 is capable of supporting seat 30 and comprises a central circular opening 101, an annular groove 102 around opening 101 with a plurality of steel balls 70 slidingly and rotatably disposed therein, a plurality of recesses 105, 106, and 107 on the underside of tray 10, a toy area 103, and a flat area 104 for retaining food, a beveage, or the like. Swivel mechanism 20 is a ring like member and consists of an upper member 21 and a lower member 22. Upper member 21 is sized to conform to circular opening 101. An annular ridge (not shown) is provided on upper member 21 inserted into annular groove 102 of tray 10 such that upper member 21 may turn freely about balls 70 on tray 10. A plurality of slots 211 are provided on the inner periphery of upper member 21. A plurality of threaded holes 212 are provided on the top surface of upper member 21. A plurality of dents 213 are provided on the outer surface of upper member 21 (FIG. 3). As such, lock member 60 on tray 10 may be engaged with one of the dents 213 so as to secure seat 30 to tray 10. Lower member 22 is also shaped to conform to circular opening 101 and comprises an annular flange 221 having an outer diameter slightly smaller than the diameter of the circular opening 101. A plurality of tabs 222 are provided around the top surface of flange 221 of lower member 221. Lower member 22 is inserted from below and into the circular opening 101 with tabs 222 snapped into slots 211 for securing lower member 22 and upper member 21 together. As a result, swivel mechanism 20 may turn freely about the circular opening 101 of tray 10.

Figure 5A:
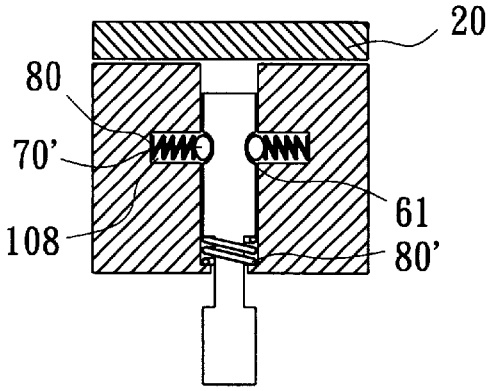
FIGS. 5A, 5B, and 5C are schematic cross-sectional views illustrating the locking operation of seat according to the first preferred embodiment of the invention.
Figure 5B:
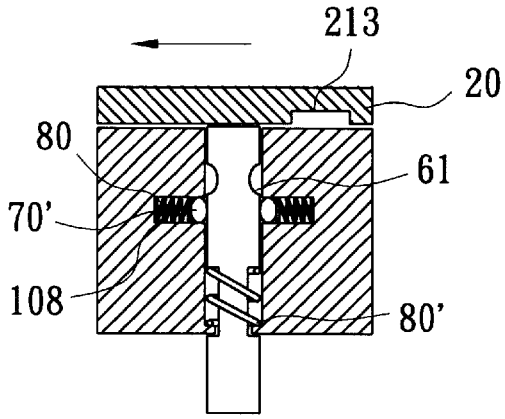
Figure 5C:
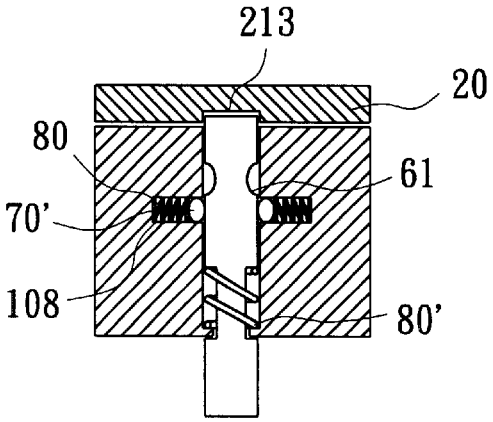

Seat 30 is adapted to receive an infant and comprises an annular frame 301 and a fabric portion 302. A plurality of holes 3011 are provided around the top surface of frame 301 such that a plurality of screws 90 may drive through holes 3011 and threaded holes 212 to secure seat 30 to upper member 21. Hence, frame 301 together with swivel mechanism 20 may freely turn. An infant may sit on the fabric portion 302 on the bottom of seat 30. Fabric portion 302 is stitched to the periphery of frame 301. Two leg openings 3021 are formed on the fabric portion 302 of seat 30 such that infant may extend its legs therethrough. Base 40 comprises a plurality of upward sockets 41, 42, and 43. Further, legs 51, 52, and 53 are intercoupled the sockets 41, 42, and 43 and the recesses 105, 106, and 107 respectively. As such, tray 10 is supported at a predetermined height above the base 40 (or the ground). Referring to FIGS. 5A to 5C, the mechanism for fastening swivel mechanism 20 to swivel seat 30 by means of lock member 60 is detailed below. Lock member 60 is provided on the top surface of tray 10. Lock member 60 is substantially an elongate bar and comprises two opposite indentation 61 on the shank and an elastic member 80' anchored on a portion of the recessed part on the shank. Two opposite holes 108 are provided in tray 10 each for receiving an elastic member 80 and a steel ball 70' (i.e., depressible spring detent). With this, lock member 60 may be configured in a retained, free, or locked state. When lock member 60 is pulled to cause balls 70 to move into indentations 61 by the expansion of elastic members 80, elastic member 80' is compressed in the recessed part of lock member 60 within tray 10 (FIG. 5A). At this position, lock member 60 is in the retained state. Further, when lock member 60 is pushed to engage with upper member 21 for causing indentations 61 to disengage from balls 70, elastic members 80 are compressed and elastic member 80' is expanded (FIG. 5B). At this position, lock member 60 is in the free state. Furthermore, when swivel mechanism 20 is rotated until one of dents 213 is aligned with the inner end of lock member 60, elastic member 80' is further expanded to bias the inner end of lock member 60 to move into engagement with the dent 213 (FIG. 5C). At this position, lock member 60 is in the locked state.

Figure 6A:
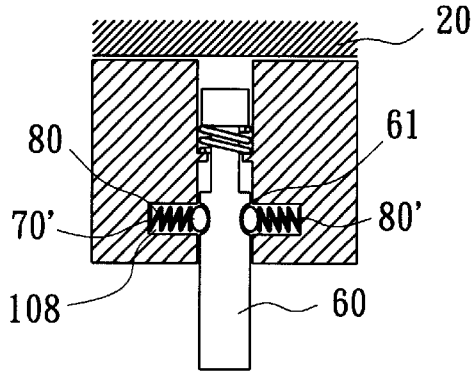
FIGS. 6A, 6B, and 6C views similar to FIGS. 5A, 5B, and 5C respectively for illustrating the locking operation of seat according to a first modification of the first preferred embodiment of the invention.
Figure 6B:
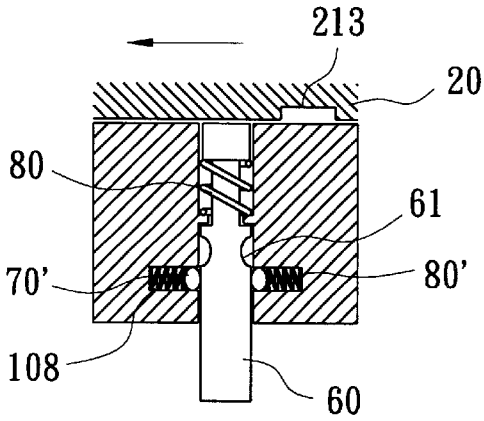
Figure 6C:
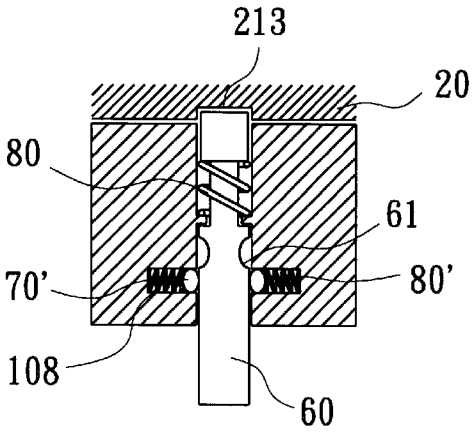

Referring to FIGS. 6A to 6C, the configuration and the locking operation of seat according to a first modification of the first preferred embodiment of the invention are illustrated. The first modification of the first preferred embodiment is configured substantially the same as that of the first preferred embodiment except that the location of elastic member 80' is inverse to that shown in FIGS. 5A to 5C.

Figure 7A:
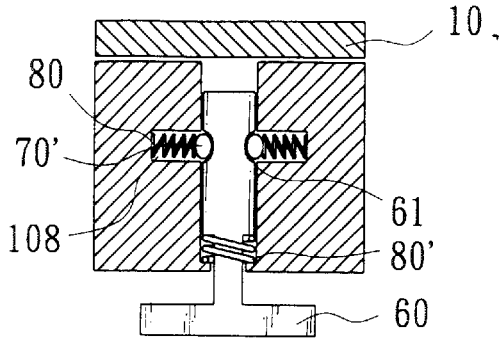
FIGS. 7A, 7B, and 7C are schematic cross-sectional views illustrating the locking operation of seat according to the second preferred embodiment of the invention.
Figure 7B:
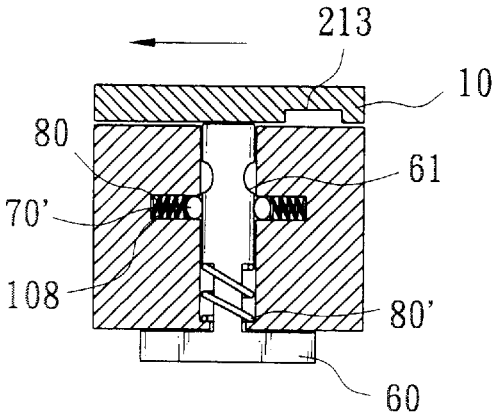
Figure 7C:
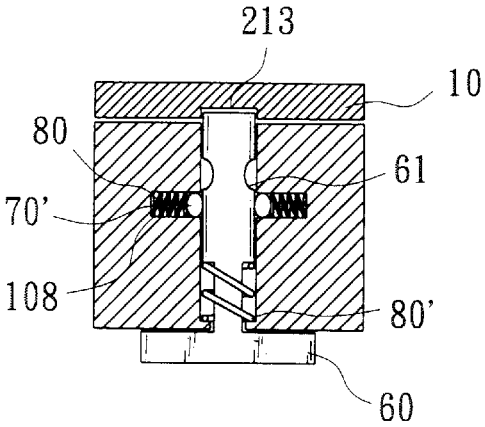

Referring to FIGS. 4, 7A, 7B, and 7C, the configuration and the locking operation of seat according to a second preferred embodiment of the invention are detailed below. Lock member 60 is provided on the top surface of upper member 21 while dents 213 are provided in tray 10. Lock member 60 is substantially a T-shaped member and comprises two opposite indentations 61 on the shank and an elastic member 80' anchored on a portion of the recessed part on the shank. Two opposite holes 108 are provided in tray 10 each for receiving an elastic member 80 and a steel ball 70' (i.e., depressible spring detent). With this, lock member 60 may be configured in a retained, free, or locked state. When lock member 60 is pulled to cause balls 70 to move into indentations 61 by the expansion of elastic members 80, elastic member 80' is compressed in the recessed part of lock member 60 within tray 10 (FIG. 7A). At this position, lock member 60 is in the retained state. Further, when lock member 60 is pushed to engage with upper member 21 for causing indentations 61 to disengage from balls 70, elastic members 80 are compressed and elastic member 80' is expanded (FIG. 7B). At this position, lock member 60 is in the free state. Furthermore, when swivel mechanism 20 is rotated until one of dents 213 is aligned with the inner end of lock member 60, elastic member 80' is further expanded to bias the inner end of lock member 60 to move into engagement with the dent 213 (FIG. 7C). At this position, lock member 60 is in the locked state.

Figure 8A:
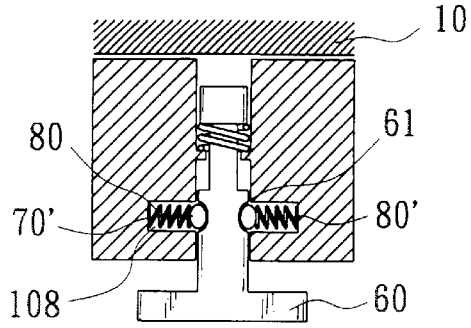
FIGS. 8A, 8B, and 8C views similar to FIGS. 7A, 7B, and 7C respectively for illustrating the locking operation of seat according to a first modification of the second preferred embodiment of the invention.
Figure 8B:
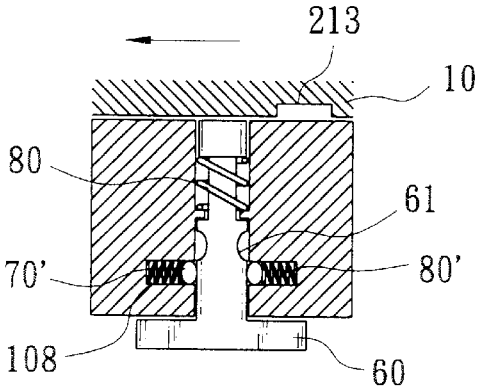
Figure 8C:
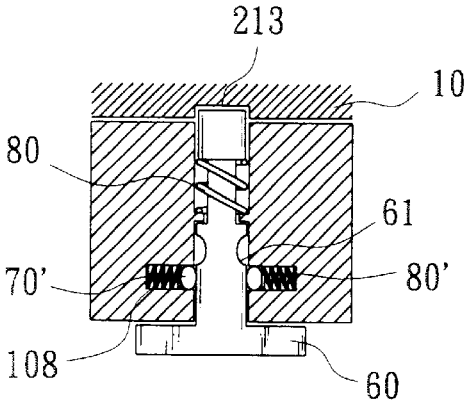

Referring to FIGS. 8A to 8C, the configuration and the locking operation of seat according to a first modification of the second preferred embodiment of the invention are illustrated. The first modification of the second preferred embodiment is configured substantially the same as that of the second preferred embodiment except that the location of elastic member 80' is inverse to that shown in FIGS. 7A to 7C.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A baby walker, comprising:

a moveable base for moving on the ground;

a plurality of legs with lower ends engaging the base; and a stationary tray above and supported by the legs, comprising:

a seat for supporting a seated infant;

a swivel mechanism being rotatably mounted on the tray for swiveling the seat, having at least one dent and at least one hole;

a steel ball received by said hole; and a lock member being capable of engaging with the dent for fastening the seat to the swivel mechanism and having an indentation, a first elastic member for the lock member being against the swivel mechanism and a second elastic member of the steel ball being against the lock member;

wherein the lock member is pulled to cause the steel ball to move into the indentation by the expansion of the first elastic member, the second elastic member is compressed to bias the lock member in a retained state, when the lock member is pushed to engage with the swivel mechanism for causing the indentation to disengage from the steel ball, the first elastic member is compressed and the second elastic member is expanded to bias the lock member in a free state, and when the swivel mechanism is rotated until the dent is aligned with the lock member, the second elastic member is expanded to bias the lock member to move into engagement with the dent to bias the lock member in a locked state.

* * * * *